United States Patent [19]

Theurer

[11] 4,069,763

[45] Jan. 24, 1978

[54] MOBILE TRACK TAMPER

[75] Inventor: Josef Theurer, Vienna, Austria

[73] Assignee: Franz Plasser Bahnbaumaschinen-Industriegesellschaft m.b.H., Vienna, Austria

[21] Appl. No.: 695,733

[22] Filed: June 14, 1976

[30] Foreign Application Priority Data

Feb. 20, 1976 Austria ..... 1238/76

[51] Int. Cl.[2] ..... E01B 27/16

[52] U.S. Cl. ..... 104/12; 104/7 R

[58] Field of Search ..... 104/7 R, 7 B, 10, 12

[56] References Cited

U.S. PATENT DOCUMENTS

| | | | |
|---|---|---|---|
| 2,956,513 | 10/1960 | Philbrick | 104/12 |
| 3,119,346 | 1/1964 | Derler | 104/12 |
| 3,177,813 | 4/1965 | Stewart | 104/12 |
| 3,669,025 | 6/1972 | Plasser et al. | 104/12 |

*Primary Examiner*—Robert J. Spar

*Assistant Examiner*—Randolph A. Reese

*Attorney, Agent, or Firm*—Kurt Kelman

[57] ABSTRACT

A mobile track tamper comprises a frame and a tamping head vertically movably mounted thereon, the tamping head including a pair of vibratory ballast tamping tool implements arranged for reciprocation in the direction of track elongation and capable of tamping ballast under track ties upon vertical downward movement of the tamping head and immersion of the tamping tool implements in the ballast. Each implement is a rigid unit which consists of a tamping tool holder and tamping tools mounted thereon. The tamping tool holder has an arm mounted on the tamping head for pivoting in a vertical plane passing through the rail and two arms extending transversely of the track from the vertically extending arm to the left and to the right of the vertical plane whereby the tamping tool holder is centered with respect to the rail. The tamping tools are symmetrically mounted on the transversely extending holder arms.

8 Claims, 3 Drawing Figures

Figure 1:
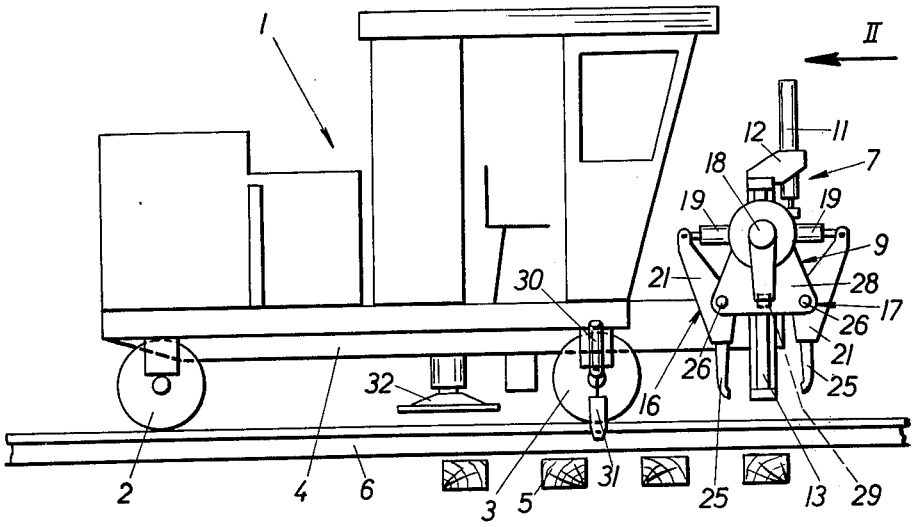

35
41
46
37
47
40
42
45
43
45
33
36
22
34
29
39
34
44
44
17
23
24
25
25
3
38
6
5

MOBILE TRACK TAMPER

The present invention relates to an improved mobile track tamper comprising a frame arranged for mobility on a track consisting of a multiplicity of ties and two rails fastened to the ties, a tamping head vertically movably mounted on the frame in vertical alignment with a respective one of the rails, and a power drive, such as a hydraulic motor, for vertically moving the tamping head. The tamping head is of the type including a pair of ballast tamping tool implements arranged for reciprocation in the direction of track elongation towards and away from each other and capable of tamping ballast under respective ones of the ties upon vertical downward movement of the tamping head and immersion of the tamping tool implements in the ballast adjacent the respective ties, a carrier whereon the ballast tamping tool implements are mounted, and drive means for vibrating and reciprocating the tamping tool implements mounted on the carrier and connected to the implements.

Mobile track tampers of this general type are well known and U.S. Pat. No. 3,000,328, dated Sept. 19, 1961, for example, discloses a tamping head comprising a tamping tool carrier vertically movable on two vertical columns and tamping tool implements mounted on the carrier to the left and to the right of the rail with which the carrier is aligned in a vertical plane. Each implement comprises two tamping tool holders each carrying a tamping tool and a separate drive vibrating and reciprocating the implement is connected to each implement. Each holder carries a single tamping tool.

Mobile track tampers with such tamping heads have been very successfully used for automatic track surfacing but the operating life of the tamping heads is rather limited because of the extreme wear to which they are exposed in tamping ballast. The forces transmitted to the vibrating and reciprocating drive means during the immersion of the ballast tamping tools in the ballast and the vibratory tamping motion are quite powerful, subjecting the tools and the tool holders to extreme stresses which, in addition, often are non-uniform, particularly between the right and the left side of the tamping head. These stresses unduly increase the play and tolerances in the connections between the tamping tool drives and the tamping tools until the entire structure becomes inoperative and the tamping head must be replaced.

It is the primary object of this invention to provide a mobile track tamper of the indicated type with tamping tool implements of simpler, more robust and more economical structure to increase the life of the tamping heads and, at the same time, improve the tamping efficiency.

The above and other objects are accomplished in accordance with the invention with the use of tamping tool implements constituted by a rigid unit. Each tamping tool implement unit consists essentially of a tamping tool holder having an arm mounted on the tamping head carrier for pivoting in a vertical plane passing through the rail with which the tamping head is associated, the holder arm being connected to the drive means for vibrating and reciprocating the tamping tool implements, and two arms extending transversely of the track from the vertically extending arm to the left and to the right of the vertical plane, and at least one tamping tool mounted on each transversely extending holder arm and extending vertically downwardly from the holder arms for immersion in the ballast to the left and to the right of the rail.

Figure 2:
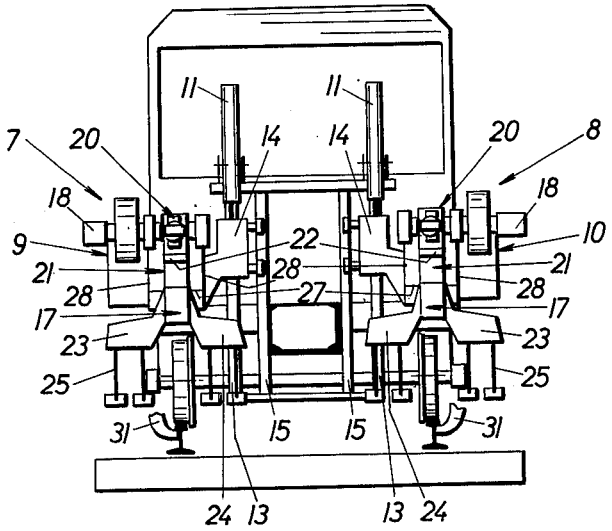
Figure 3:
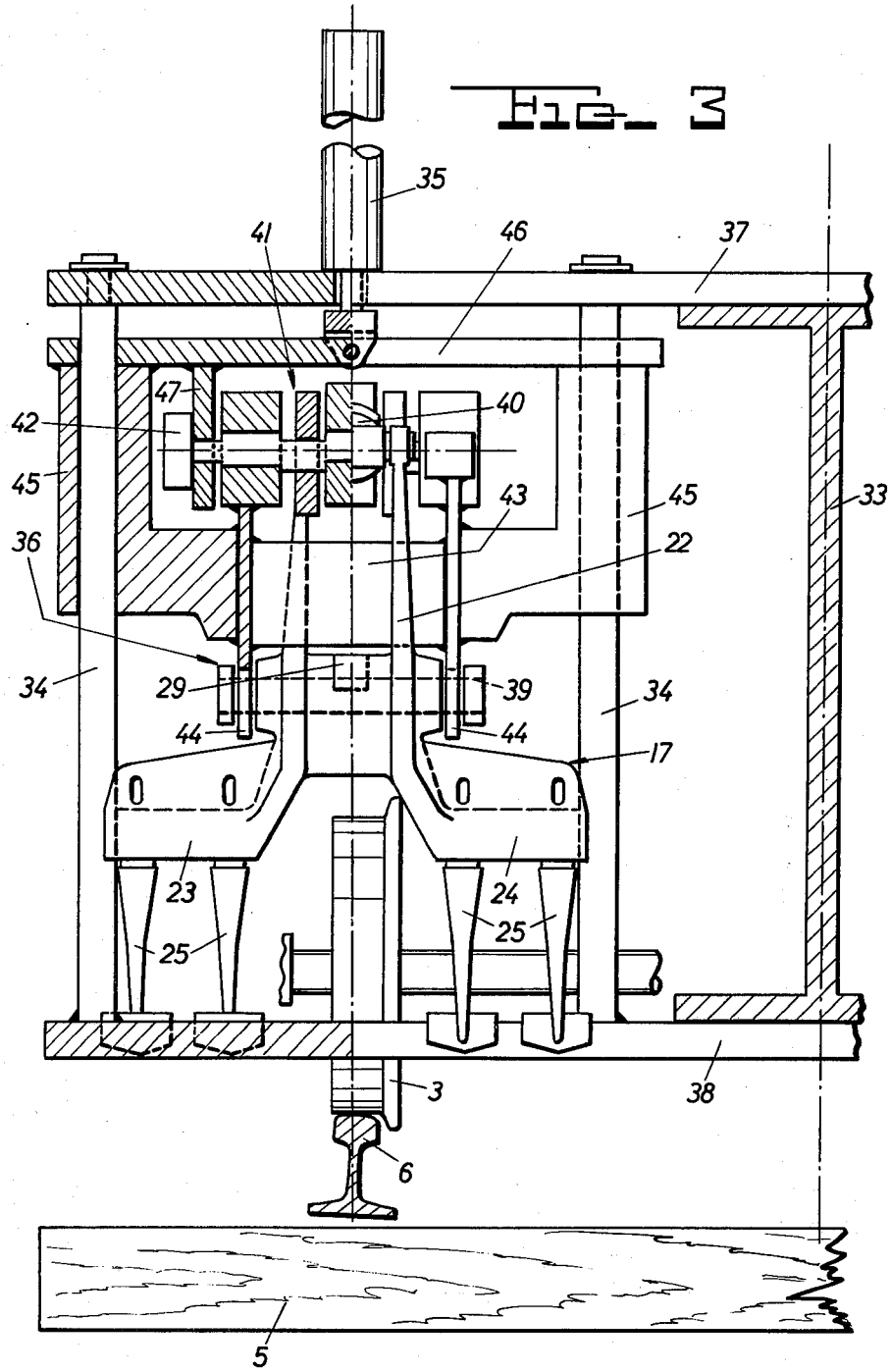

The above and other objects, advantages and features of this invention will become more apparent from the following detailed description of now preferred embodiments thereof, taken in conjunction with the accompanying schematic drawing wherein FIG. 1 is a side elevational view of one specific embodiment of a tamper according to the invention;

FIG. 2 is an end view of the tamper in the direction of arrow II of FIG. 1; and FIG. 3 shows another embodiment, only the tamping head being illustrated, the tamper frame being shown in partial transverse cross section and the tamping head being shown in partial section along a plane of symmetry of the tamping head.

The tamping tool implement used in the track tamper of the present invention has been described and claimed in simultaneously filed U.S. patent application Ser. No. 695,732, entitled "Ballast Tamping Implement on a Mobile Track Tamper", of the same inventor.

Referring now to the drawing and first to FIGS. 1 and 2, the track on which mobile track tamper 1 is arranged for mobility consists of a multiplicity of ties 5 and two rails 6 fastened to the ties. The tamper comprises rear undercarriage 2 and front undercarriage 3 supporting frame 4 for mobility on the track, the frame having a portion freely overhanging the front undercarriage and tamping heads 7 and and 8 being mounted on the overhanging frame portion mirror-symmetrically with respect to a vertical center plane of the track and in transverse alignment with respect to the track. The tamping heads are vertically movably mounted on frame 4 in vertical alignment with rails 6 and a power drive 11 consisting of a hydraulic motor or jack is connected to each tamping head for vertically moving the tamping head.

In the preferred embodiment shown in FIGS. 1 and 2, the tamping heads are vertically movably mounted by vertical guide column 13 mounted on frame 4 and supporting each tamping head carrier 9, 10 for vertical movement on the tamper frame, vertical guide track 15 mounted on the tamper frame adjacent each column 13 and guide means 14 consisting of a sliding part interengaging the guide column and the guide track for each tamping head for guiding the respective carrier thereof on the column along the guide track. In the illustrated embodiment, separate drives 11 are connected to each tamping head for independent vertical movement of the tamping heads but, if desired, a single drive may be connected to both tamping heads for common movement thereof.

Each tamping head includes a pair of ballast tamping tool implements 16, 17 arranged for reciprocation in the direction of track elongation towards and away from each other and capable of tamping ballast under respective ones of ties 5 upon vertical downward movement of the tamping head and immersion of the tamping tool implements in the ballast adjacent the respective ties, with the tamped tie positioned between the implements. The tamping tool implements are mounted on carriers 9 and 10. The illustrated drive means for vibrating and reciprocating the tamping tool implements are mounted on the respective tamping head carrier and are connected to implements 16 and 17 of each tamping head. They include crank drive 20 centered above rail 6 between a pair of vertical support webs 28 arranged on each carrier symmetrically with respect to the rail and a hydraulic motor 19 for reciprocating the tamping tool implements mounted in the vertical plane of the rail and linked to the upper end of each implement, the crank drive being operatively associated with the hydraulic reciprocating motor. As shown, sliding part 14 is mounted on one of the vertical support webs 28 of each tamping head carrier while hydraulic motor 18 is mounted on the other vertical support web for driving crank drive 20. The vertical supports are interconnected by bracing element 27.

Each tamping tool implement 16, 17 is constituted by a rigid unit which is substantially fork-shaped and arranged astride rail 6, as fully shown in FIG. 2. It consists essentially of tamping tool holder 21 and tamping tools 25 detachably mounted on the holder for ready replacement in a manner more fully described and claimed in the simultaneously filed application. The illustrated tamping tool holder is substantially ⊥-shaped and has arm 22 extending between support webs 28, 28 and being pivotally mounted thereon for pivoting in a vertical plane. The illustrated arm 22 consists of two webs and has a longitudinal plane of symmetry, and the pivoting plane is vertical to the track and passes through rail 6, the longitudinal plane of symmetry of tamping tool holder arm 22 extending on the vertical plane. Two arms 23, 24 extending transversely of the track from vertically extending arm 22 to the left and to the right of the vertical plane whereby tamping tool holder 21 is centered with respect to rail 6. Transversely extending holder arms 23, 24 are arranged mirror-symmetrically at the lower ends of vertically extending holder arm 22 and the upper end of each vertical holder arm is linked to reciprocating drive 19.

In the embodiment of FIGS. 1 and 2, pivot 26 mounts each vertically extending holder arm 22 on the tamping head carrier support webs 28, 28 intermediate the ends of the implements. The pivot is arranged adjacent transverse holder arms 23, 24 and extends substantially parallel thereto.

As shown in connection with the embodiment of FIG. 3, stop 29 is mounted on the bracing element interconnecting the vertical support webs of the carrier. The stop is positioned substantially in the vertical plane of rail 6 and is designed to delimit the vertical movement of the tamping head carrier.

The pivotal mounting of the tamping tool implements and their connection to the reciprocating and vibrating drive illustrated in FIGS. 1 and 2 has the particular advantage of accurately centering the tamping operation in respect of the points of intersection between ties and rails, the transmission of tamping forces from the drives to the tamping jaws of tools 25 being very effective due to the bellcrank lever-like pivoting movement of the tamping tool implements in the vertical planes passing through the rails. The tamping pressures are uniform and the structure is very robust and easy to service.

The pivotal mounting of the tamping tool implements between a pair of braced support webs and the vertical guidance of the tamping head carrier along a guide column enables the relatively high loads coming from the left and right of the rail from the tamping tools to the carrier to be transmitted thereto uniformly, thus avoiding unbalanced stresses on the pivots and correspondingly severe wear on the bearings as well as assuring a uniform force distribution.

The illustrated arrangement of the drive means for the tamping tool implements and the vertical guidance for the tamping head carrier produces an exceedingly compact tamping unit with a minimum of transmission members while the eccentric guidance enables various structural arrangements to be made in connection with different types of tampers, including switch tampers.

The mirror-symmetric arrangement shown in FIG. 2 produces a mobile track tamper of very simple structure and very easy to service, the required drives for the tamping tools being almost halved in comparison with known tamping tool arrangements. The symmetrical and centered mounting of the tamping head carriers on the machine frame between the two rails produces a very robust structure having a long operating life. When both tamping heads are operated simultaneously, as will be done most of the time in practice and which may be achieved simply by rigidly interconnecting the tamping tool carriers of both heads for common vertical movement or by a suitable control for simultaneously operating drives 11, the ballast at both intersections of the rails with the tie being tamped will be compacted very effectively and uniformly.

The use of the novel tamping tool implements in otherwise generally conventional tamping heads unexpectedly produces tamping heads of highly simplified construction, requiring only a single drive means common to all the tamping tools to the left and to the right of the rail. Furthermore, this simple construction produces a transmission of forces substantially free of play from the common drive means for the implements to the tamping tool jaws which tamp the ballast in a continuous flow of force, thus increasing the efficiency of tamping with the same power input to an unexpected degree. This transmission of force causes nearly no loss in the amplitude of vibrations during the transmission and assures almost 100% efficiency in transmitting the reciprocatory force from drives 19 to the tamping tool implements. The rigid tamping tool implement unit tamps the ballast uniformly and very effectively to the right and to the left of the rail so that better tamping is obtained at less cost.

When tamping heads 7 and 8 are coupled for simultaneous tamping of both rails, with simultaneous immersion of all the vibrating tamping tools in the ballast and simultaneous reciprocation thereof to tamp the ballast therebetween under an interposed tie 5, the tamped ballast may exert an upward thrust of such power that a relatively light tamper of the type illustrated in FIG. 1 may be lifted off the track by this thrust since the front portion of the tamper frame freely overhangs the front undercarriage so that there is relatively little counterweight exerted upon the track at the tamped tie. To avoid this possibility, a power-actuatable clamping means is mounted on frame 4 in the region of front undercarriage 3 for clamping the frame to the track rails, the illustrated clamping means comprising clamp 31 mounted for pivoting about an axis extending in the direction of track elongation and jack 30 for pivoting the clamp into a clamping position wherein it subtends the head of associated rail 6. In this manner, the tamper is locked to the track during tamping.

To enable the mobile tamper to be moved in either direction along the track, the tamper frame is mounted on turntable 32 vertically movably mounted on frame 4 between the undercarriages. In this manner, the frame may simply be turned 180° to reverse its operating direction.

In the embodiment of FIG. 3, tamper frame 33 is centered between rails 6 and carries struts 37 and 38 extending from the center frame over the rails. A pair of vertical guide columns 34, 34 vertically movably mount tamping head 36 on the tamper frame between the struts, only front undercarriage 3 supporting the tamper frame for mobility on the track being shown in the drawing. Hydraulic motor 35 is mounted on upper strut 35 and is connected to the tamping head for vertically moving the same on columns 34, 34.

The tamping tool implement is more or less identical with that of the previously described embodiment and is constituted by a rigid unit consisting essentially of vertical holder arm 22, transverse holder arms 23 and 24, and pairs of tamping tools 25, 25 mounted on each transverse holder arm to the right and to the left of rail 6, each tamping tool implement being mounted astride the rail. Pivot shaft 39 mounts the implement for pivoting intermediate its ends and adjacent the transverse holder arms on vertical support webs 44, 44 interconnected by bracing element 43. Crank drive 41 for vibrating the implements is rotated by hydraulic motor 42 and is associated with hydraulic drive 40 linked to the upper end of holder arm 22 for reciprocating the implements, all substantially as explained hereinabove. As shown, carrier arms 45, 45 are welded to the support webs and have longitudinal guide bores through which vertical guide columns 34, 34 extend, the two carrier arms being interconnected by strut 46 welded to the carrier arms to provide a sturdy carrier. Vertical drive 35 is linked to carrier strut 46 which carries support bracket 47 on which hydraulic motor 42 is mounted, the bearings connecting motor 47 to eccenter shaft drive 41 and drive 40 to the upper ends of holder arm 22 being welded to vertical support webs 44, 44 as clearly shown in FIG. 3.

While the invention has been described in connection with certain now preferred embodiments, it will be clearly understood that structural modifications and variations will occur to those skilled in the art, particularly after benefitting from the present teaching, without departing from the spirit and scope of this invention as defined in the appended claims. For instance, the rigid tamping tool implement holder may be an integral cast iron structure or may consist of welded parts. While it may be an integral part or may consist of several parts, it must be rigid for arrangement astride a track rail. Of course, instead of mounting a pair of tamping tools to the left and right of the rail, a single tool may be so mounted on each transverse holder arm. Also, instead of linking the upper ends of the tamping tool implement to the reciprocating and vibrating drive, and pivoting the implements about a central pivot, this arrangement may be reversed and the implements may be linked to the drive intermediate their ends while they pivot about their upper ends. The latter arrangement may be particularly preferred if the reciprocating drive is not a hydraulic motor but a mechanical spindle-and-nut drive, as used on some tamping heads. Furthermore, the implement may be used not only in the illustrated type of tamping head wherein a pair of tamping tools is mounted astride a tie for tamping ballast under the tie by a pincer movement of the tools but also in known arrangements wherein two tamping tool implements are immersed in the same crib and are moved apart towards the adjacent ties wherebetween the implements are immersed.

What is claimed is:

1. A mobile track tamper comprising a frame arranged for mobility on a track consisting of a multiplicity of ties and two rails fastened to the ties, a tamping head vertically movably mounted on the frame in vertical alignment with a respective one of the rails, and a power drive for vertically moving the tamping head, the tamping head including a pair of ballast tamping tool implements arranged for reciprocation in the direction of track elongation towards and away from each other and capable of tamping ballast under respective ones of the ties upon vertical downward movement of the tamping head and immersion of the tamping tool implements in the ballast adjacent the respective ties, a carrier whereon the ballast tamping tool implements are mounted, and drive means for vibrating and reciprocating the tamping tool implements mounted on the carrier and connected to the implements, wherein each ballast tamping tool implement is constituted by a rigid unit consisting essentially of 1. a tamping tool holder having
   a. an arm having a longitudinal plane of symmetry and mounted on the carrier for pivoting in a plane vertical to the track and passing through the rail, the longitudinal plane of symmetry of the tamping tool holder arm extending in the vertical plane and the holder arm being connected to the drive means, and
   b. two arms rigidly connected to, and extending transversely of the track from, the vertically extending arm to the left and to the right of the vertical plane, and
2. at least one stationary tamping tool mounted on each of the transversely extending holder arms and extending vertically downwardly from the holder arms for immersion in the ballast to the left and to the right of the rail.

2. The mobile track tamper of claim 1, wherein two of said tamping tools are mounted on each transverse holder arm symmetrically with respect to the rail, and further comprising a pivot mounting the vertically extending holder arm on the carrier intermediate the ends of the implement, the pivot being arranged adjacent the transverse holder arms and extending substantially parallel thereto.

3. The mobile track tamper of claim 1, further comprising a vertical guide column supporting the tamping head carrier for vertical movement on the tamper frame, the carrier including a pair of vertical support webs arranged symmetrically with respect to the rail and a bracing element interconnecting the support webs, and the vertically extending tamping tool holder arm extending between the support webs and being pivotally mounted thereon.

4. The mobile track tamper of claim 3, further comprising a stop mounted on the bracing element substantially in said vertical plane for delimiting the vertical movement of the tamping head carrier.

5. The mobile track tamper of claim 3, further comprising a vertical guide track mounted on the tamper frame adjacent the guide column, guide means mounted on one of the vertical support webs for guidingly engaging the guide column and guide track for guiding the carrier on the column along the guide track, and the drive means including a crank drive for vibrating the tamping tool implements, the crank drive being centered above the rail between the vertical support webs, a hydraulic motor mounted on the other vertical support web for driving the crank drive, and a hydraulic motor for reciprocating the tamping tool implements mounted in the vertical plane and linked to the upper end of each vertical holder arm, and the crank drive being operatively associated with the hydraulic reciprocating motor.

6. The mobile track tamper of claim 1, further comprising a rear and a front undercarriage supporting the frame for mobility on the track, the frame having a portion freely overhanging the front undercarriage and the tamping head being mounted on the overhanging frame portion, and power-actuatable clamping means in the region of the front undercarriage for clamping the frame to the track rails.

7. A mobile track tamper comprising a frame arranged for mobility on a track consisting of a multiplicity of ties and two rails fastened to the ties, a tamping head vertically movably mounted on the frame in vertical alignment with each rail, a power drive for vertically moving the tamping head, the tamping heads being arranged mirror-symmetrically with respect to a vertical center plane of the track and in transverse alignment with respect to the track, each tamping head including a pair of ballast tamping tool implements arranged for reciprocation in the direction of track elongation towards and away from each other and capable of tamping ballast under respective ones of the ties upon vertical downward movement of the tamping tool heads and immersion of the tamping tool implements in the ballast adjacent the respective ties, a carrier wherein the ballast tool implements are mounted, and drive means for vibrating and reciprocating the tamping tool implements mounted on the carrier and connected to the implements, wherein each ballast tamping tool implement is constituted by a rigid unit consisting essentially of 1. a tamping tool holder having
   a. an arm mounted on the carrier for pivoting in a vertical plane passing through the rail with which the tamping head is vertically aligned, the holder arm being connected to the drive means, and
   b. two arms rigidly connected to, and extending transversely of the track from, the vertically extending arm to the left and to the right of the vertical plane, and
2. at least one stationary tamping tool mounted on each of the transversely extending holder arms and extending vertically downwardly from the holder arms for immersion in the ballast to the left and to the right of the rail; and the tamping heads are vertically movably mounted by
3. a vertical guide column supporting each of the tamping head carriers for vertical movement on the tamper frame;
4. a vertical guide track mounted on the tamper frame adjacent each of the guide columns; and
5. guide means guidingly interengaging the guide column and guide track for each tamping head for guiding the carrier thereof on the column along the guide track.

8. The mobile track tamper of claim 7, further comprising a rear and a front undercarriage supporting the frame for mobility on the track, the frame having a portion freely overhanging the front undercarriage and the tamping head being mounted on the overhanging frame portion, and poweractuatable clamping means in the region of the front undercarriage for clamping the frame to the track rails.

* * * * *